United States Patent [19]

Maier

[11] 3,979,675

[45] Sept. 7, 1976

[54] CIRCUIT INTERRUPTER

[75] Inventor: Alfred E. Maier, Beaver Falls, Pa.

[73] Assignee: Westinghouse Electric Corporation, Pittsburgh, Pa.

[22] Filed: Apr. 7, 1975

[21] Appl. No.: 565,500

[52] U.S. Cl. ..... 335/16; 335/135

[51] Int. Cl.[2] ..... H01H 77/10

[58] Field of Search ..... 317/46, 58; 335/18, 335/16, 195, 135

[56] References Cited

UNITED STATES PATENTS

| | | | |
|---|---|---|---|
| 3,211,955 | 10/1965 | Soos, Jr. | 317/58 |
| 3,505,582 | 4/1970 | Hoppe et al. | 317/58 |
| 3,745,414 | 7/1973 | Frantti | 317/58 |

*Primary Examiner*—Harold Broome
*Attorney, Agent, or Firm*—L. P. Johns

[57] ABSTRACT

A circuit interrupter for a power control system which is characterized by a circuit breaker and an electrically insulating housing, which housing comprises separable molded portions. The circuit breaker comprising at least two sets of pairs of movable and stationary contacts in stacked relationship, the stationary contacts being mounted on internal conductors extending through aligned openings in the housing and being connectable to external conductors. The housing has molded support means for retaining the internal conductors in stacked aligned positions. The movable contacts are mounted on movable contact means including bridging contact members and an actuator for moving the bridging contact members in unison between open and closed positions of the contact. Solenoid means are provided for closing the contacts. In addition, a slot motor can be provided on the bridging contact members for opening the circuit in response to a very high current overload in order to provide a current limiting type breaker. Finally, a current transformer can be provided on the internal conductors for opening the circuit in response to other current overloads.

6 Claims, 3 Drawing Figures

CIRCUIT INTERRUPTER

BACKGROUND OF THE INVENTION

1. Field of the Invention

This invention relates to a circuit interrupter having a plurality of poles which are operable in unison and which are disposed in a stacked relationship within a circuit breaker housing.

2. Description of the Prior Art

Heretofore, a switchboard or control panel has involved a plurality of bus bars to which a plurality of circuit breakers are attached in a conventional manner. Cross-connectors have also been required in the panel. The total amount of metal, which is usually copper, comprising the bus bars and connectors has been substantial as well as unjustified.

SUMMARY OF THE INVENTION

It has been found in accordance with this invention that the foregoing problems may be overcome by providing a circuit interrupter comprising a circuit breaker and an electrically insulating housing having an access opening therein, a cover for the opening, at least two sets of circuit breaker structures within the housing and comprising sets of pairs of movable and stationary contacts, means for opening and closing the contacts and comprising a crossbar for each pair of movable contacts and a connecting element, the sets of contacts being disposed in a stacked arrangement, the crossbars being mounted on the connecting element in spaced positions, the movable contacts being mounted on the crossbars, the connecting elements operable to move the crossbars simultaneously between open and closed positions, operating means operatively connected to the connecting element for moving the contacts to the closed position and comprising a solenoid or a spring operated mechanism, a first conductor leading to one of each pair of stationary contacts, a second conductor leading to the other of each pair of stationary contacts, the first conductor being in stacked spaced relation and extending to the housing, the second conductors being in stacked spaced relation and extending through the housing, means responsive to a current overload for moving the connecting element to the open position, the housing comprising supporting means for holding the conductors in place, the outer end portions of each set of first and second conductors being aligned and comprising common means interconnected between the end portions of each set of conductors for tightening a connection with a conduit of an electrical circuit, releasable means operatively connected to each crossbar for holding the crossbar in the open circuit position, and current transformer means operatively connected to each first conductor for tripping the circuit breakers when a current exceeds a preestablished current rating.

DESCRIPTION OF THE PREFERRED EMBODIMENT

Figure 2:
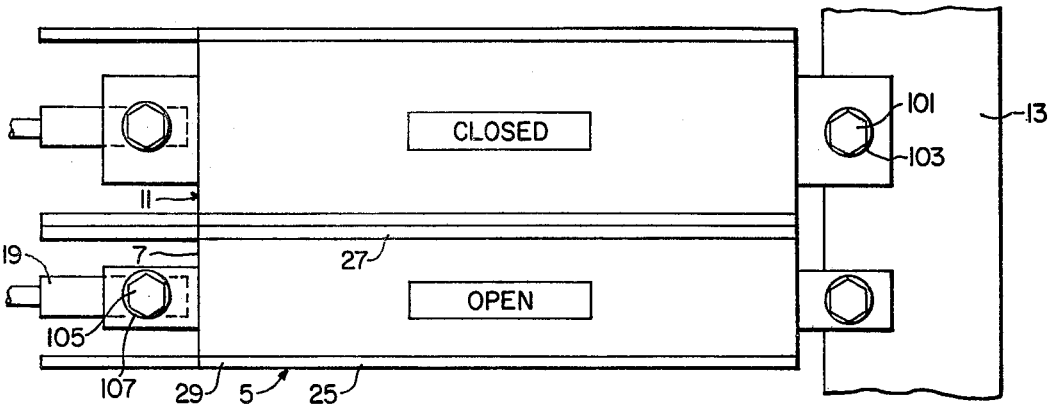
FIG. 2 is a plan view of the circuit interrupter shown in FIG. 1.
Figure 1:
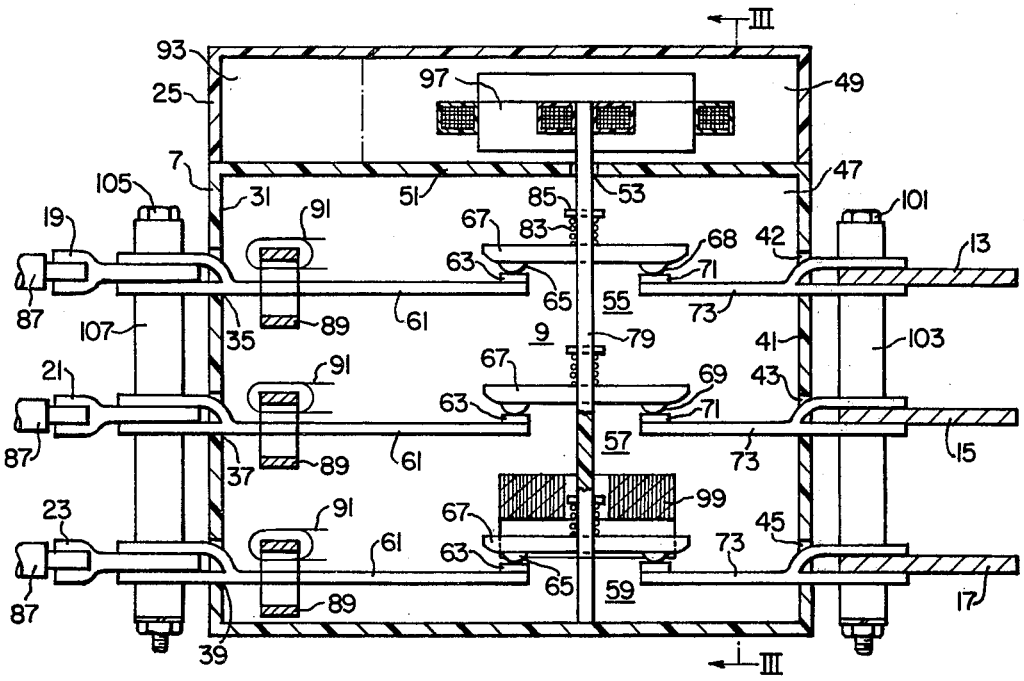
FIG. 1 is a vertical sectional view through the circuit interrupter of this invention.

In FIG. 1 a circuit interrupter is generally indicated at 5 and it comprises a housing 7 and a circuit breaker 9 disposed within the housing. As shown in FIG. 2, a pair of circuit interrupters 5 and 11 are disposed in side-by-side relationship between stacked bus bars 13, 15, 17, on the right and load terminals 19, 21, 23 on the left. The housing 7 is a sandwich-type construction having an intermediate bos-like frame 25 and a pair of outer covers 27, 29 disposed on opposite sides of the frame. The frame 25 comprises opposite end walls 31, 33 in which apertures 35–45 are provided. The end wall 31 includes the apertures 35, 37, 39, and the end wall 41 includes the apertures 42, 43, 45. When assembled, the frame 25 and covers 27, 29 provide a chamber 47 in which the circuit breaker 9 is located.

In addition, the assembled frame 25 and covers 27, 29 provide a compartment 49 which is divided from the chamber 47 by a partition 51 having an aperture 53. The housing including the frame 25 and covers 27, 29 as well as the partition 51 are composed of an electrically insulating and thermosetting material, such as glass-filled phenolic resin or glass-filled polyester resin.

Figure 3:
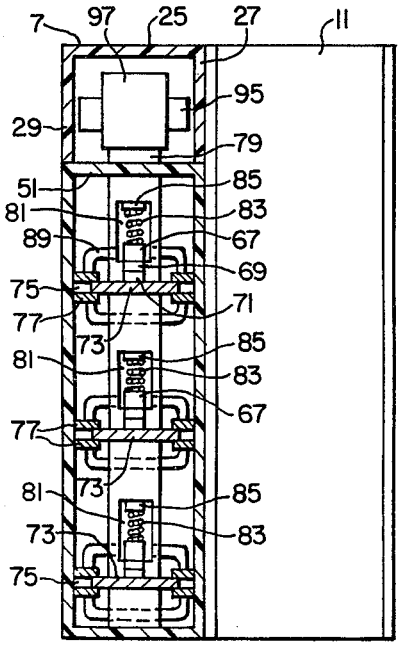
FIG. 3 is a vertical sectional view taken on the line III—III of FIG. 1.

The circuit breaker 9 is a multi-pole breaker having preferably three pole units 55, 57, 59 which comprise similar conductors 61, stationary contacts 63, movable contacts 65, bridging contact carrier or crossbars 67, movable contacts 69, stationary contacts 71, and conductors 73. As shown in FIG. 3, the conductors 73 are mounted in the chamber 47 by suitable mounting means, such as conductor-receiving grooves 75, which are integral with the covers 27, 29, such as provided by inwardly extending ribs 77 on the inner surfaces of the covers. The conductors 61 are similarly mounted to minimize the number of additional parts required for the assembled circuit interrupter 5.

The bridging contact carriers 67 are all mounted on an elongated member or shaft or connecting element 79 in which openings or windows 81 are provided at spaced intervals. Each bridging contact carriers 67 extends through one opening 81 and is retained against the lower end of the opening by coil springs 83. The upper end of the springs urges against spring retainers 85 at the upper end of each opening in a conventional manner. When the shaft 79 is in the lower-most position, as shown in FIG. 1, the springs 83 hold the bridging contact carriers 67 down with the movable contacts 65, 69 in good electrical contact with the stationary contacts 63, 71. Thus, a circuit through the circuit interrupter 5 extends from the bus bars 13, 15, 17 through the several conductors 73, the contacts and the carriers 67, and through the conductors 61 to the load conductors or cables 87. When any one of the circuit breaker units 55, 57, 59 experiences a current overload, a current transformer 89 detects low to moderate current overloads. Each current transformer 89 includes a secondary coil 91 which is connected to a solid stage trip circuit 93 which in turn opens a circuit through a coil 95 of a solenoid 97, whereby the shaft 79 is lifted to open the circuits through the several breaker units 55, 57, 59.

In addition to the current transformers 89, each circuit breaker unit 55, 57, 59 can be provided with a slot motor 99 for handling extremely high short circuit currents. The construction and operation of a slot motor is set forth in U.S. Pat. No. 3,815,059 as well as in application Ser. No. 390,283, filed Aug. 21, 1973, and Ser. No. 437,586, filed Jan. 29, 1974. The slot motor 99 comprises a plurality of laminations of relatively thin generally U-shaped plates of soft magnetic material, such as iron, that are secured together in a face-to-face relationship. The assembled plates form a slot 100 for receiving the crossbar 67, which slot is relatively narrow, open at the bottom and closed at the top. A magnetic flux is generated by the current in the crossbar 67 and operates in the slot motor 99 in a magnetic flux path. Upon the occurrence of a heavy overload current above a predetermined value the electromagnetic forces are sufficient to lift the crossbar 67 into the upper end of the slot 100. The shaft 79 also moves up to lift the remaining crossbars 67.

The circuits through the circuit breaker units 55, 57, 59 are closed by lowering the shaft 79 either manually by a spring operated mechanism or by reactivation of the solenoid 97.

In summary, this invention provides a circuit interrupter in which a plurality of poles are disposed in a stacked arrangement which enables the use of a sandwich-type housing 7, the provision of bus bars 13, 15, 17 to which the separate conductors 73 are connected by a single bolt 101 with insulating tubular dividers 103 therebetween. Likewise, the outer ends of the conductors 61 are separately connected to separate line cables 87 by a single bolt 105 with separate tubular insulating dividers therebetween. As a result of the compact arrangement of the circuit breaker units 55, 57, 59 and the bus bars 13, 15, 17, as well as the cables 87, a more compact circuit interrupter is provided. A concomitant advantage of the compact arrangement is the great reduction in the amount of bus bars necessary in a panel or switchboard in which the circuit interrupter is located.

In addition, for different ratings the width of the breaker is increased or decreased by changing the width of the stationary conductors 61, 73 and moving conductors 67. The number of moving conductors 67 could also be increased for higher rating breakers. The same side covers 25–27 could be used then for different rating breakers.

The same housing and solenoid could be used for contactor type duty with arc chutes and slot motors omitted.

For normal breaker type duty the slot motors would be omitted and the arc chutes retained.

Therefore the same basic parts could be used for making contactors, standard breaker and current limiting breakers. Even the different ratings of each of these devices would be made by only changing the width of the device.

The single bolt connection at both line and load would cut installation time and reduce maintenance time to approximately one third.

What is claimed is:

1. A circuit interrupter comprising a circuit breaker and an electrically insulating housing having an access opening therein, a cover for the opening, at least two sets of circuit breaker structures within the housing and comprising sets of pairs of movable and stationary contacts, means for opening and closing the contacts and comprising a crossbar for each pair of movable contacts and a connecting element, the sets of contacts being disposed in a stacked arrangement, the crossbars being mounted on the connecting element in spaced positions, the movable contacts being mounted on the crossbars, the connecting element being operable to move the crossbars simultaneously between open and closed positions, a first conductor leading to one of each pair of stationary contacts, a second conductor leading to the other of each pair of stationary contacts, the first conductors being in stacked spaced relation and extending through the housing, the second conductors being in stacked spaced relation and extending through the housing, and means responsive to a current overload for moving the connecting element to the open position and comprising a slot motor including a body of laminated sheets of magnetic material having a slot in which one crossbar is disposed for generating a magnetic flux in the body which flux is sufficient to lift the cross bar along the slot so as to move the movable contacts to the open position.

2. The circuit interrupter of claim 1 in which operating means are operatively connected to the connecting element for moving the contacts to the closed position.

3. The circuit interrupter of claim 2 in which the operating means comprises a solenoid.

4. The circuit interrupter of claim 3 in which the housing comprises support means for supporting the conductors in place.

5. The circuit interrupter of claim 4 in which the outer end portions of each set of first and second conductors are aligned and comprise common means interconnected between the end portions of each set of conductors for tightening a connection with a conductor of an electrical circuit.

6. The circuit interrupter of claim 4 in which current transformer means are operatively connected to each first conductor for tripping the circuit breaker when the current exceeds a preestablished current rating.

* * * * *